US005198834A

United States Patent [19]

Childers et al.

[11] Patent Number: 5,198,834

[45] Date of Patent: Mar. 30, 1993

[54] INK JET PRINT HEAD HAVING TWO CURED PHOTOIMAGED BARRIER LAYERS

[75] Inventors: Winthrop D. Childers; Hai Q. Tran, both of San Diego, Calif.

[73] Assignee: Hewlett-Packard Company, Palo Alto, Calif.

[21] Appl. No.: 679,378

[22] Filed: Apr. 2, 1991

[51] Int. Cl.[5] ..... B41J 2/05

[52] U.S. Cl. ..... 346/1.1; 346/140 R

[58] Field of Search ..... 346/140, 1.1

[56] References Cited

U.S. PATENT DOCUMENTS

| | | | |
|---|---|---|---|
| 4,394,670 | 7/1983 | Sugitani | 346/140 R |
| 4,412,224 | 10/1983 | Sugitani | 346/140 R X |
| 4,417,251 | 11/1983 | Sugitani | 346/140 X |
| 4,490,728 | 12/1984 | Vaught et al. | 346/140 X |
| 4,535,343 | 8/1985 | Wright et al. | 346/140 |
| 4,558,333 | 12/1985 | Sugitani et al. | 346/140 |
| 4,683,481 | 7/1987 | Johnson | 346/140 |
| 4,809,428 | 3/1989 | Aden et al. | 346/140 X |
| 4,882,595 | 11/1989 | Trueba et al. | 346/140 |
| 4,970,532 | 11/1990 | Komuro | 346/140 R |

*Primary Examiner*—Joseph W. Hartary
*Attorney, Agent, or Firm*—Edward Maker, II

[57] ABSTRACT

A pen head (14) for a drop-on-demand ink jet pen is disclosed along with its method of manufacture. The pen head utilizes a barrier wall (24) located between a substrate (20) and an orifice plate (22). Ink (17) flows through the pen head in channels defined in the barrier wall. The barrier wall is fabricated in two layers (58,60) from cured, photoimaged resist materials. One layer (58) is a soldermask material; and the other (60), a photolithographic resist material. The two layers together resist chemical attack by the inks and mechanical separation of the orifice plate (22) from the pen head.

23 Claims, 9 Drawing Sheets

TO FIG_5E

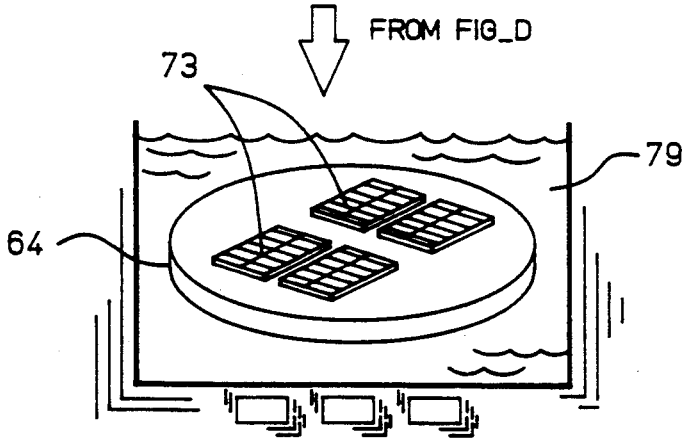
FIG_5E
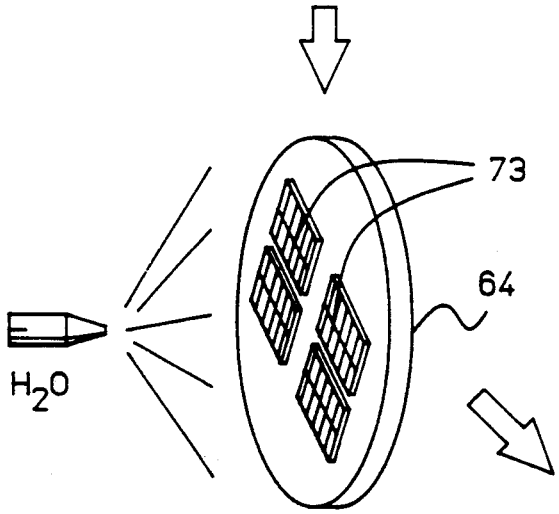
FIG_5F
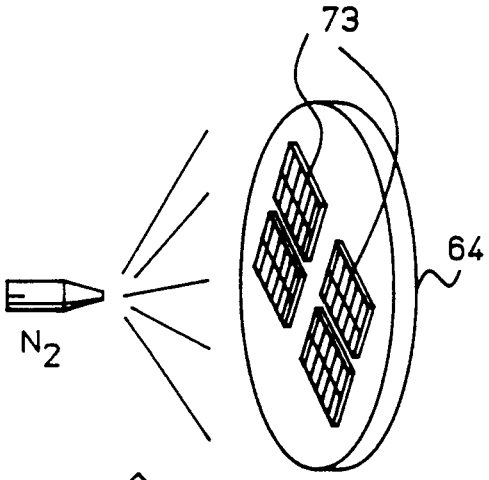
FIG_5G
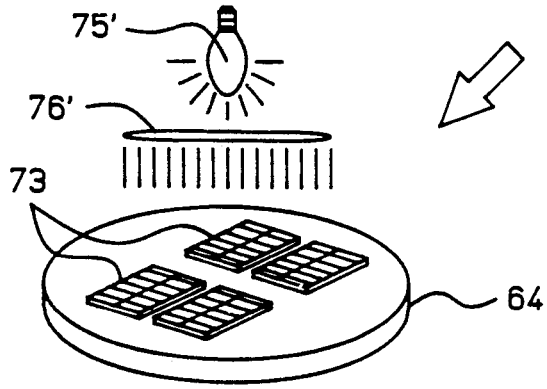
FIG_5H
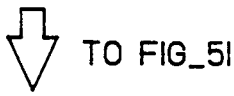

TO FIG_5M

INK JET PRINT HEAD HAVING TWO CURED PHOTOIMAGED BARRIER LAYERS

BACKGROUND OF THE INVENTION

1. Field of the Invention

This invention generally relates to drop-on-demand ink jet printers and, more particularly, with the method of manufacturing a component of the ink propulsion system. The term "ink jet" as used herein is intended to include all drop-on-demand ink propulsion systems including, but not limited to, "bubble jet,""thermal ink jet" and piezoelectric.

2. Description of the Prior Art

The basic concept of ink jet printing is described in U.S. Pat. No. 4,490,728 entitled "Thermal Ink Jet Printer" issued Dec. 25, 1984 to Vaught et al.

The general construction of a thermal ink jet print head is described in U.S. Pat. No. 4,683,481 entitled "Thermal Ink Jet Common-Slotted Ink Feed Printhead" issued Jul. 28, 1987 to Johnson.

The general arrangement of thermal ink jet barriers, nozzle plates, resistors, and ink flow paths is disclosed in U.S. Pat. No. 4,882,595 entitled "Hydraulically Tuned Channel Architecture" issued Nov. 21, 1989 to Trueba et al.

These patents disclose a print head having an ink containing capillary with an orifice for ejecting ink and an ink heating mechanism, generally a resistor, in close proximity to the orifice. In operation, the ink heating mechanism is quickly heated, transferring a significant amount of energy to the ink, thereby vaporizing a small portion of the ink and producing a bubble in the capillary. The bubble in turn creates a pressure wave which propels an ink droplet or droplets from the orifice onto a nearby writing surface. By controlling the energy transfer to the ink, the bubble quickly collapses before it can escape from the orifice.

There are two problems due to the ink which arise with respect to the barriers which define the ink channels within printheads. The first problem is that the ink chemically attacks the barrier and causes either leakage between the channels and/or leakage to the outside of the pen and also causes swelling of the barriers. Swelling results in a change in channel geometry and a degradation from optimized performance. The problem of chemical attack is especially important with the newly developed inks having pH's in excess of 9 and highly penetrating cosolvents. The second problem is adhesion of the orifice plate. In most applications the orifice plate has a nickel surface and is bonded to the print head using a combination of heat and pressure. If the ink attacks the ink channels, it can destroy the adhesion of the orifice plate and cause delamination or separation of the orifice plate from the print head.

The use of hardened photosensitive resins to form barrier walls is generally disclosed in U.S. Pat. No. 4,417,251 entitled "Ink Jet Head" issued Nov. 22, 1983 to Sugitani and U.S. Pat. No. 4,558,333 entitled "Liquid Jet Recording Head" issued Dec. 10, 1985 to Sugitani et al.

There is a further problem of selecting appropriate materials for the fabrication of barriers. Barriers are produced today from negatively acting, photoimageable material. These materials have been used for many years in the manufacture of both printed circuit boards and integrated circuits. However, a typical photoimageable material that is used for printed circuit boards can resolve 8 mil (203.2 microns) traces and 8 mil (203.2 micron) spaces. In addition, typical materials used in integrated circuits have a resolution of 1 micron traces and 1 micron spaces. In contrast, the present invention requires resolution for approximately 20 micron traces and 20 micron spaces which is in between the typical specifications for printed circuit board and integrated circuits.

In other words, the materials commonly used in the manufacture of printed circuit boards can not be used in the present invention because these materials do not provide the high order of resolution that is required. If these materials are used to fabricate barriers, the resulting barriers are rough and granular. These are defects which cause unwanted flow discontinuities, obstructions and turbulence within the ink channels.

Likewise the materials commonly used for integrated circuits are unusable because they are optimized to resolve dimensions on the order of 1 micron. When used to fabricate barriers having dimensions of approximately 25 microns, most integrated circuit materials lose all resolution. The material to be removed from the channels becomes too polymerized and can not be removed by conventional techniques.

The foregoing status of the art thus indicates that a need has existed in this field for a barrier segment material which can withstand the corrosion of high pH inks, stop delamination of the orifice plate, and also provide the required ink channel resolution.

SUMMARY OF THE INVENTION

The present invention contemplates a pen head for a drop-on-demand ink pen incorporating a barrier segment having two layers of cured photoimaged material. The first layer of material is cured on a substrate and the second layer is cured on the first layer and generally overlies it. The second layer adhesively bonds the first layer of the barrier segment and in turn the substrate to an orifice plate.

In one aspect of the invention, the first layer is fabricated from a liquid soldermask material and the second layer is fabricated from a liquid photolithographic resist material.

In another aspect of the invention, in one embodiment the two barrier layers are stacked in registration and in a second embodiment the upper layer overlies the lower layer as well as covers the lower layer's sidewalls.

It is an object of the present invention to provide a barrier material having two layers for a drop-on-demand pen head. The first layer is resistant to chemical attack by high pH inks. A second layer is selected to adhesively join the first layer to the orifice plate and thereby overcome delamination.

Other objects and advantages of the present invention together with additional features will become apparent from the following description and the accompanying illustrations of the preferred embodiments.

BRIEF DESCRIPTION OF THE DRAWINGS

The present invention will be described with reference to the accompanying drawings, wherein.

DETAILED DESCRIPTION OF THE PREFERRED EMBODIMENTS

Figure 1:
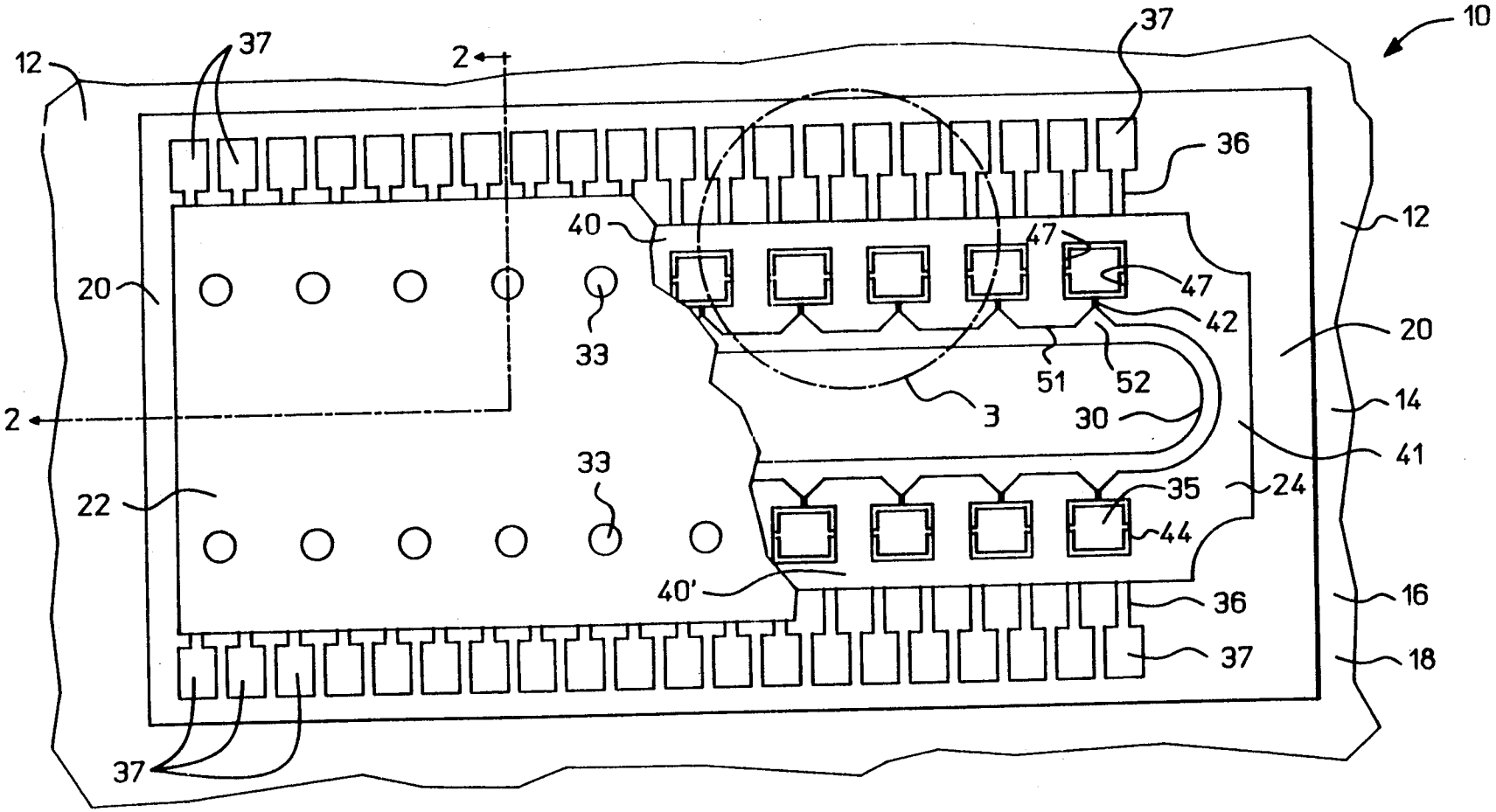
FIG. 1 is a top plan view, cutaway, of a print head and pen body according to the present invention.
Figure 2:
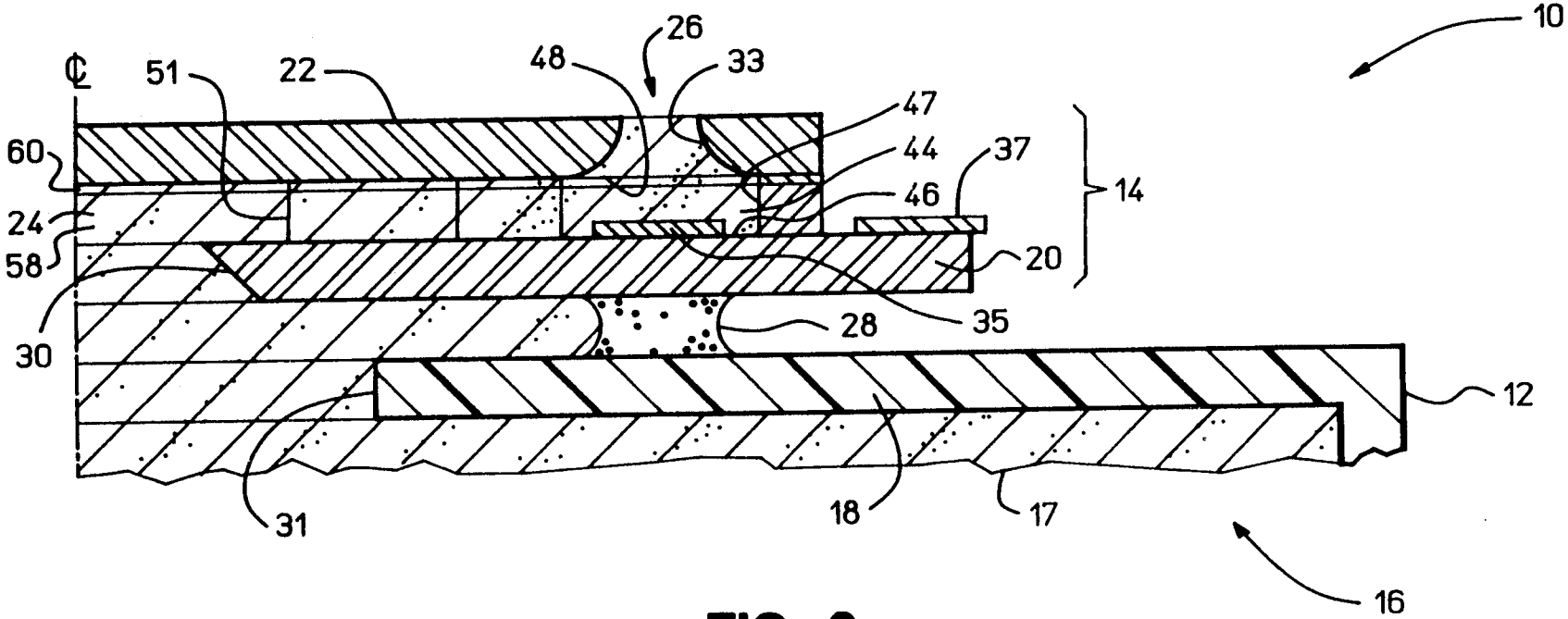
FIG. 2 is a side elevational view in cross section and cutaway of the print head and pen body of FIG. 1 taken along line 2—2.
Figure 3:
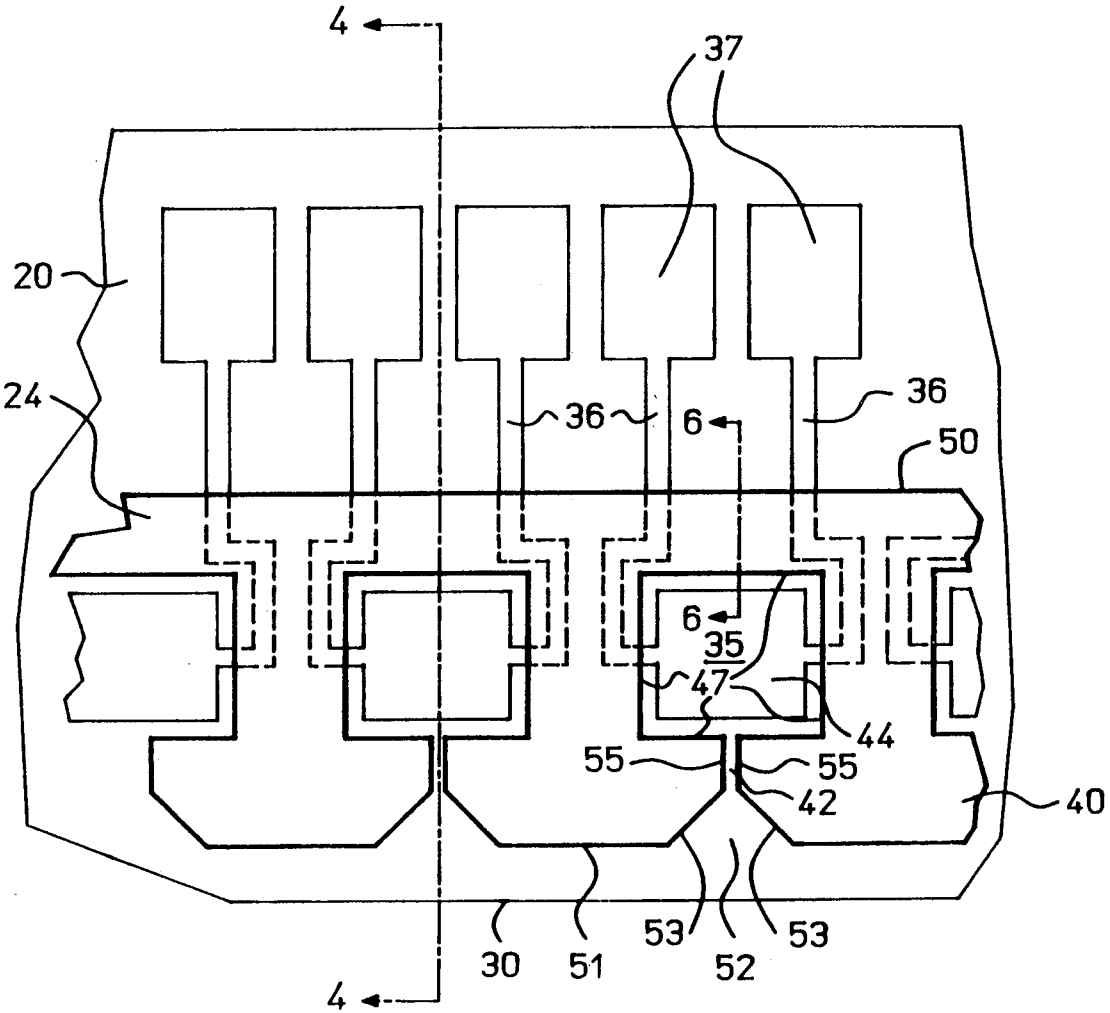
FIG. 3 is an enlarged top plan view, cutaway, of the area of the print head and pen body indicated by circle 3 of FIG. 1.

Referring to FIGS. 1, 2 and 3, reference numeral 10 generally indicates an ink jet pen from which ink is expelled drop by drop on demand onto a paper or other printing medium (not shown). The ink jet pen 10 includes a pen body 12 and a pen head 14. The ink jet pen is mounted in a printer (not shown) which moves the pen and the paper and electrically actuates the pen on command.

The pen body 12, FIGS. 1 and 2, is the skeletal structure of the pen and functions as a chassis for all of the parts. The pen body contains an ink reservoir 16 of which one ink reservoir wall 18 is shown in FIG. 2 for the ink 17. The pen body is fabricated from injection molded plastic in the conventional manner.

THE PEN HEAD 14

The pen head 14, FIG. 2, comprises the following components: a substrate 20, an orifice plate 22, a barrier segment 24, and means for expelling ink on demand through an orifice in the orifice plate 22.

More specifically, the pen head 14, FIG. 2, is connected to the pen body 12 by a bead of adhesive 28. The adhesive is a conventional epoxy compound which rigidly attaches the substrate 20 to the pen body 12 and seals the ink within the pen as described below.

The pen head 14, FIG. 2, further includes the substrate 20 on which thin films and barrier structures are fabricated. These thin films are described in U.S. Pat. Nos. 4,535,343 and 4,809,428 issued to Wright et al. and Aden et al., respectively. The substrate is silicon and is dye cut from either a four or six inch wafer. The substrate further includes a feed slot 30 which is mechanically formed in the substrate and overlies a larger feed hole 31, FIG. 2, in the pen body 12.

The orifice plate 22, FIGS. 1 and 2, provides the top wall of the ink channel and the ink firing chamber as described below. The orifice plate is fabricated from electro-formed nickel and the orifice 33 directs the ink droplets onto the paper or other printing medium (not shown).

The means for expelling ink 26, FIG. 2, from the ink jet pen 10 includes a plurality of resistors 35. These resistors are tantalum aluminum, thin films which are located on the substrate 20. When a resistor is heated by a pulse of electric current, the resistor transfers a significant amount of energy to the ink, thereby vaporizing a small portion of the ink and producing a bubble. The bubble in turn creates a pressure wave that propels a drop of ink through the orifice 33. The resistors 35 are electrically pulsed through thin film, conductive leads 36, FIG. 1, that are connected to the pads 37. The pads and leads are fabricated from aluminum and are coated with a layer of gold. The conductive leads are thereafter covered with a silicon carbide layer (not shown) to prevent corrosion by the ink. When the ink jet pen 10 is positioned in a printer (not shown), the ink jet pen is electrically actuated by the printer through mechanical contacts (not shown) with the pads.

Referring to FIGS. 1 and 3, the barrier 24 of the pen head 14 attaches the orifice plate 22 to the substrate 20 and defines the sidewalls of the ink channels and the boundaries of the firing chambers 44. The barrier generally includes two parallel, longitudinal segments 40, 40' and two parallel latitude segments 41, formed and cured in one continuous layer on the top surface of the substrate 20 and around the ink feed slot 30. The two longitudinal segments 40, 40' each contain a row of rectangular shaped hollow, firing chambers 44 located in side by side relationship. Each firing chamber 44 is defined by a bottom wall 46 which is the substrate 20, four side walls 47 which are formed in the barrier 24 and a top wall 48 which is the under surface of the orifice plate 22. A resistor 35 is located on the bottom wall 46 of each firing chamber and overlying each resistor is an orifice 33.

Referring to FIGS. 2 and 3, the barrier 24, further includes an outer side wall 50 and an inner side wall 51 which is proximate to the feed slot 30 in the substrate 20. The barrier 24 also includes a constriction area 52, FIG. 3 including two converging side walls 53, 53'. The constriction area is defined by the converging side walls, the top surface of the substrate 20, and the lower surface of the orifice plate 22. Fluid communication between the constriction area 52 and the firing chambers 44, FIG. 3 is obtained through one of the ink channels 42. Each ink channel is defined by two substantially parallel ink channel side walls 55, FIG. 3 which are formed in the barrier 24. The ink channel 42 is further defined by the top surface of the substrate 20 and the bottom surface of the orifice plate 22 in the same manner as the firing chambers 44 and the constriction areas 52.

In summary, it can be now understood that one major function of the barrier 24, FIGS. 2 and 3, is to contain the ink so that it does not flow between the firing chambers 44 or flow out of the pen head 14 except through the orifice 33.

THE FLOW PATH OF INK

The flow path of the ink 17, FIG. 2, is through the following areas and past the following components, in sequence. The ink is initially contained within the ink reservoir 16 defined by the ink reservoir wall 18. On demand, the ink flows out of the reservoir, through the feed hole 31, past the adhesive 28 and through the feed slot 30 in the substrate 20. The ink thereafter flows past the inner side wall 51 of the barrier 24 and into one of the constriction areas 52, FIG. 3. The ink next flows past the converging side walls 53, into the ink channel 42, FIG. 3, and through the ink channel parallel side walls 55. Next, the ink enters the firing chamber 44 and on demand is expelled out of the orifice 33 of the orifice plate 22 and on to the printing medium (not shown).

THE BARRIER—IN DETAIL

Figure 4:
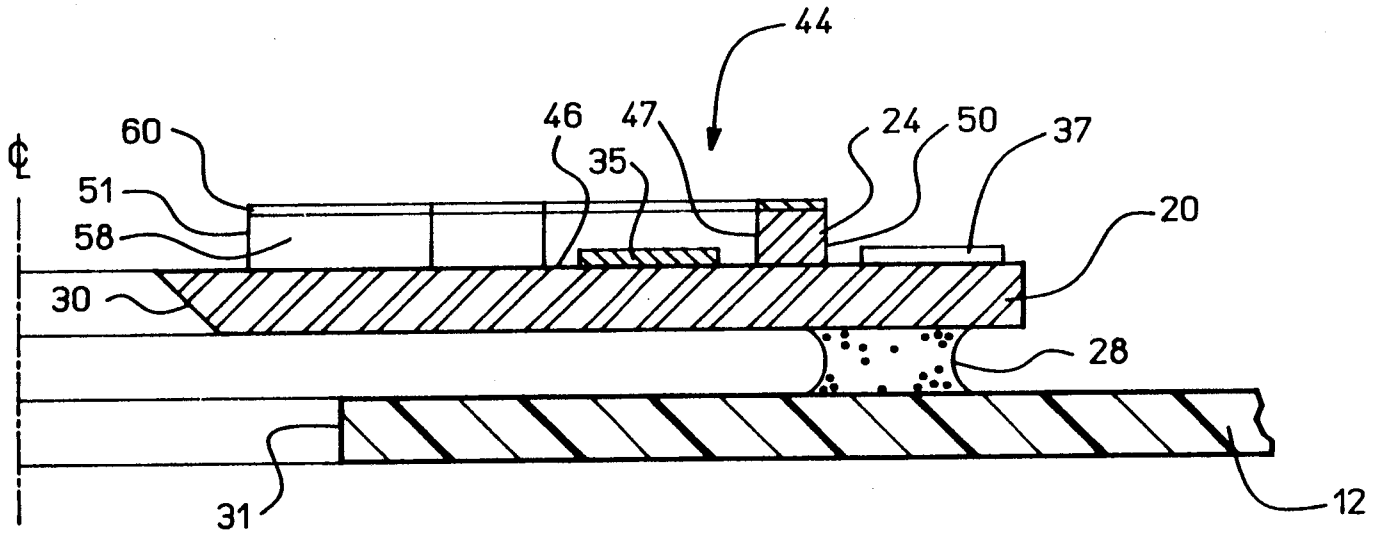
FIG. 4 is a side elevational view in cross section and cutaway of the print head and pen body of FIG. 2 with the orifice plate not yet installed.
Figure 6:
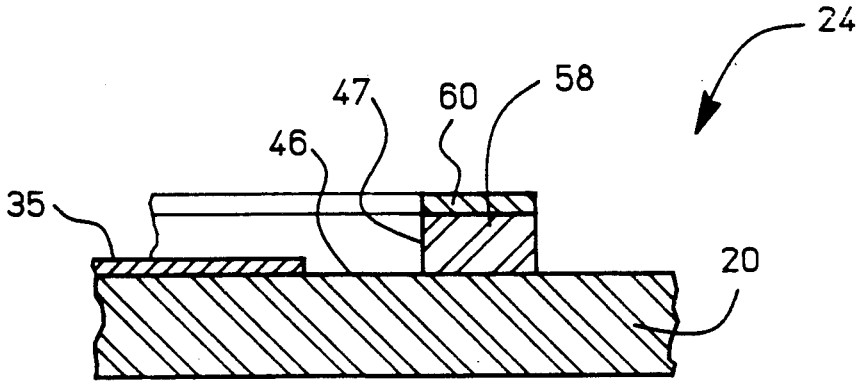
FIG. 6 is a side elevational view in cross section and cutaway, taken along line 6—6 of FIG. 3.

Referring to FIGS. 2, 4 and 6, the barrier 24 includes a first layer 58 and a second layer 60. The second layer overlies the first layer in registration and each layer in plan view has substantially the same shape.

The first layer 58, FIGS. 4 and 6, is fabricated from a liquid photoimageable, negatively acting, photoresist compound that has been cured on the silicon substrate 20. In one embodiment of the present invention, a soldermask material of high resolution is used. The first layer material is selected such that it may be coated on the substrate to a thickness of approximately 25 microns. It is preferable that the soldermask material contain no filler or pigments and preferably have a viscosity in the range of approximately 300 centipoise and a molecular weight of between 100 and 500 before cross linking.

One such soldermask material is Dynachem X-3005, an epoxy acrylate, which can be obtained from the Dynachem Company of Tustin, Calif. Dynachem X-3005 is developed with a solvent based developer such as sodium bicarbonate. Other possible materials include Vacrel and Parad, which are DuPont dry films.

The second layer 60, FIGS. 4 and 6 is cured on top of the first layer 58 after the first layer has been cured. The second layer is fabricated from a liquid, negatively acting, lithographic photoresist compound of high resolution of the type typically used in the manufacture of integrated circuits. This material is chosen so that it may produce a layer having a thickness of approximately 5 microns and so that it adhesively couples the first layer 58 and the orifice plate 22 together after the application of heat and pressure. Typically the second layer 60 has a molecular weight of between 1 million and 2 million before cross linking.

One preferred photoresist for the second layer 60 is Waycoat SC Resist 900, Catalog No. 839167 which can be obtained from Olin Hunt Specialty Products, Inc., a subsidiary of Olin Corporation of West Paterson, N.J. This resist is diluted with Waycoat PF Developer, Catalog No. 840017 to a ratio of 70 weight percent of SC Resist to 30 weight percent of developer. This photoresist is developed using Waycoat Negative Resist Developer, Catalog No. 837773.

In one embodiment of the present invention used in an ink jet pen that produces six hundred dots per inch (600 dpi) the distance between the center line of one ink channel 42, FIG. 3 and the next adjacent ink channel or the distance between repeating elements in the pattern of the barrier wall 24 is about 84.7 microns. The width of the ink channel 42 is between 15 and 35 microns and preferably about 20 microns. The thickness of the barrier wall is between 10 and 30 microns and preferably approximately 20 microns. The thickness of the first layer 58 is in the range of 10 to 20 microns, preferably 15 microns and the thickness of the second layer 60 is in the range of 1 to 10 microns, preferably 5 microns. The length of the ink channel sidewalls 55, FIG. 3 is approximately 40 microns and the converging side walls 53 converge at an angle of approximately 45 degrees. The length and width of the firing chamber 44 is approximately 50 microns.

METHOD OF MANUFACTURE

Figure 5A:
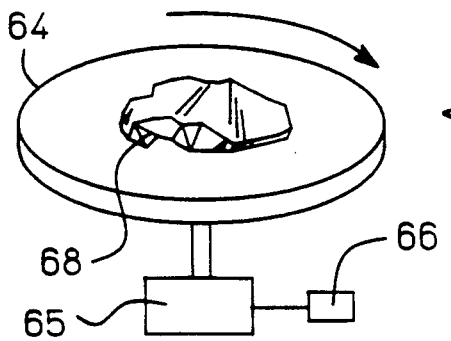
FIGS. 5A through 5P are diagrammatic elevational views illustrating the process for fabricating the print head of the present invention.
Figure 5A:
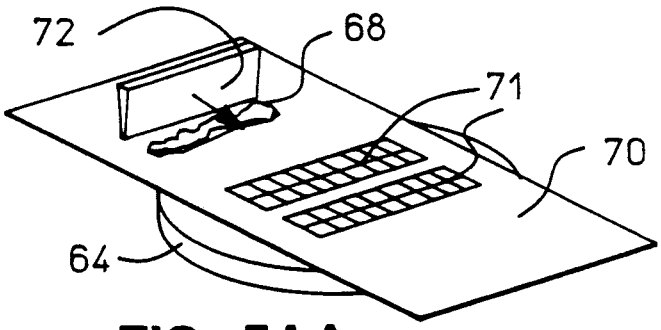

Referring to FIG. 5A, a conventional 4 or 6 inch silicon wafer 64 is initially centered on the chuck (not shown) of a conventional photoresist spinner 65. The spinner's speed is regulated by a controller 66. The thin films are already on the wafer including the resistors 35, the conductive leads 36 and the pads 37, FIG. 3. Liquid soldermask material 68 is placed on the center of the wafer and the wafer is spun through a normal spin cycle to evenly spread the resist material over the entire surface of the wafer 64. The speed and duration of the spin cycle can be varied as well as the viscosity of the resist material in order to achieve the desired thickness of the barrier. One feature of the present invention is the ability to change these parameters so as to obtain a desired barrier thickness.

Figure 5B:
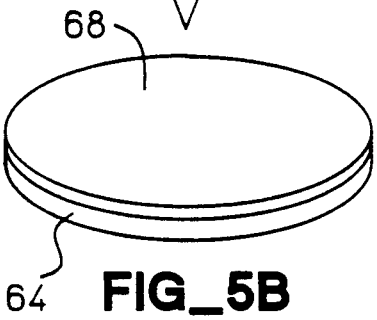
Figure 5B:
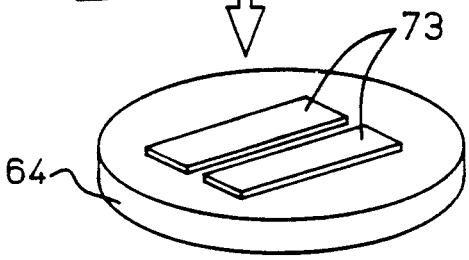

Referring to FIG. 5B, the silicon wafer 64 and the soldermask material 68 in a partially dried state are now removed from the spinner. The soldermask material 68 uniformly covers the surface of the wafer at a desired thickness.

Figure 5C:
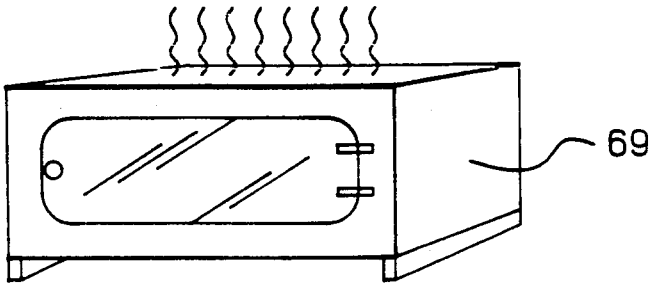

Referring to FIG. 5C, the wafer is then "softly" baked in a convection oven 69 to remove the volatile solvents which were initially present in the liquid resist material in FIG. 5A. This step does not usually cause polymerization of the resist material.

Referring to FIG. 5AA, the liquid soldermask material 68 can also be placed on the silicon wafer 64 using a screen printing mask 70. This mask uses a 150 mesh screen 71 having a pattern of rectangular segments. The photoresist is applied using a squeegee 72 which forces the photoresist through the mesh and on to the silicon wafer 64. The mesh size of the screen 71 determines the final thickness of the segments 73, FIG. 5BB. The thickness of the rectangular segments 73, FIG. 5BB corresponds to the thickness of the uniformly flat layer of resist material 68, FIG. 5B. The rectangular segments are likewise softly baked in the convection oven 69, in the same manner as described above.

Figure 5D:
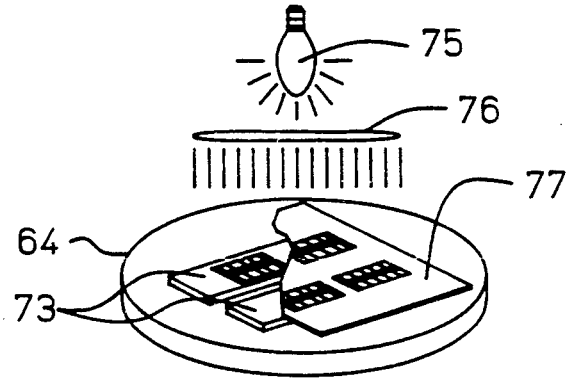

Referring to FIG. 5D, the softly baked photoresist material is next subjected to a standard integrated circuit lithographic photomask exposure process. This process includes the use of an ultraviolet light source 75 and a lens 76 that produces highly collimated light. The light passes through a conventional photomask 77 and impinges on either the rectangular segments 73 or the uniformly flat layer 68, FIG. 5B. The photo mask 77 blocks out those regions on the liquid resist which are not to be polymerized. The photo mask 77 includes a plurality of barrier patterns each of which contains firing chambers 44, ink conduits 42, constriction areas 52, etc. as illustrated in FIG. 3. At the end of the exposure period those areas of the photoresist which were exposed to the ultraviolet light are polymerized and the unexposed portions of the resist remain as monomers.

Referring to FIG. 5E, the wafer 64 undergoes a conventional developing process in an ultrasonic developing tank 79 containing a bath of conventional developer solution. In the developing step, the photoresist material which was not exposed to the ultraviolet light, FIG. 5D, is dissolved by the developer and removed by agitation. In other words, the monomers are chemically and mechanically removed leaving the first layer 58 of resist with a plurality of barrier patterns like the single pattern illustrated in FIGS. 1 and 3.

Referring to FIGS. 5F and 5G, the silicon wafer 64 is thereafter rinsed with a water spray and then dried using a stream of nitrogen gas. The nitrogen quickly dries the wafer so that no residue is left behind.

Referring to FIG. 5H, the wafer 64 and the first layer 58 of resist are next subjected to a second ultraviolet exposure. An ultraviolet light source 75' is used to produce ultraviolet light which impinges on the first layer 58 of the barrier. No photo mask is used. This step is called a blanket exposure and produces a fully polymerized (crosslinked) first layer.

Figure 5M:
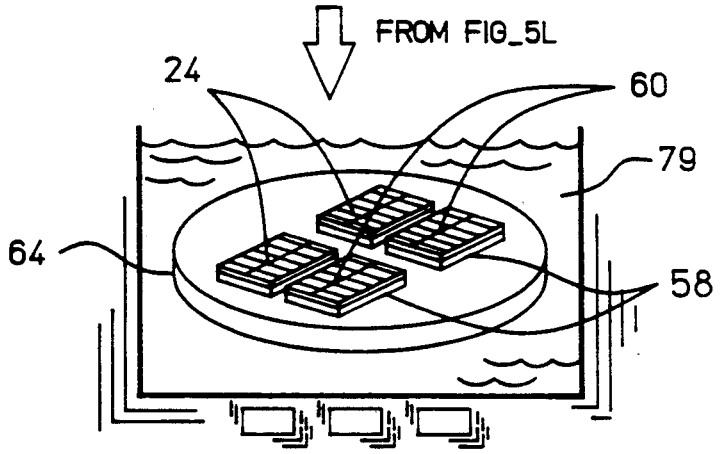
Figure 5N:
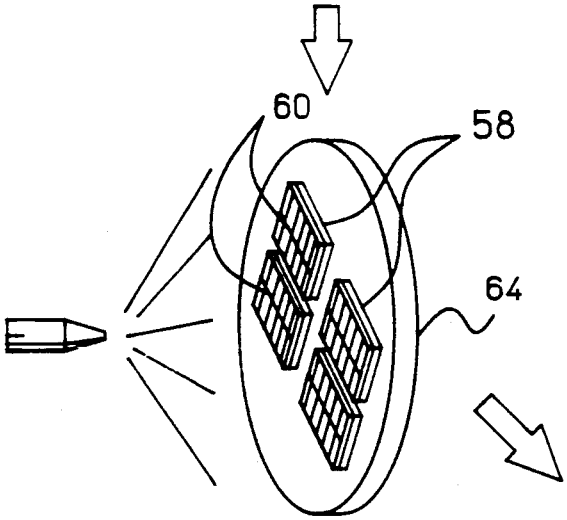
Figure 5O:
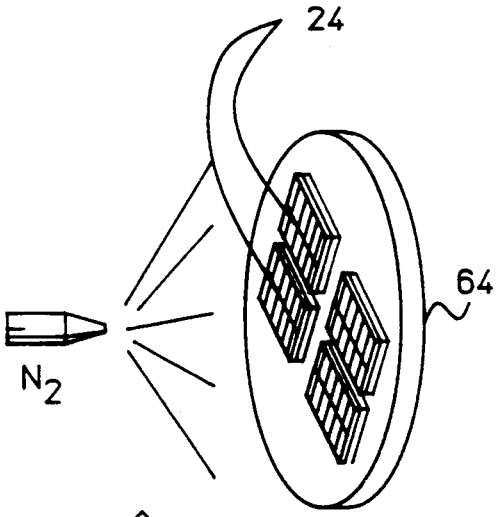
Figure 5P:
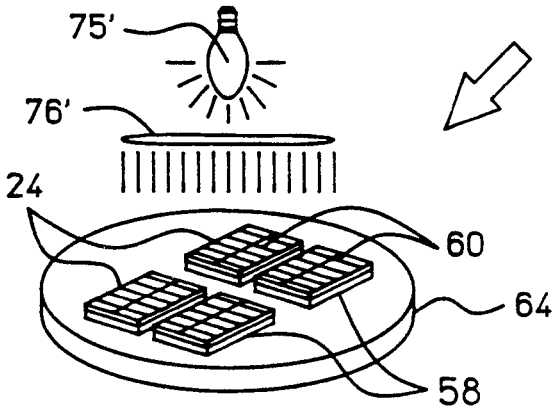
Figure 5I:
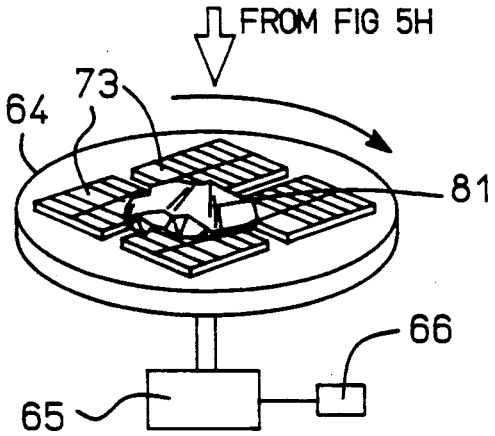
Figure 5J:
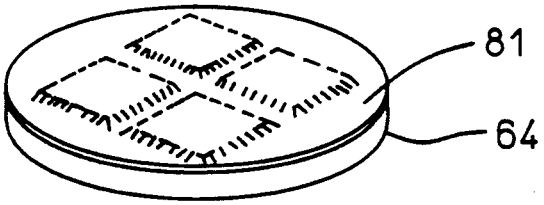
Figure 5K:
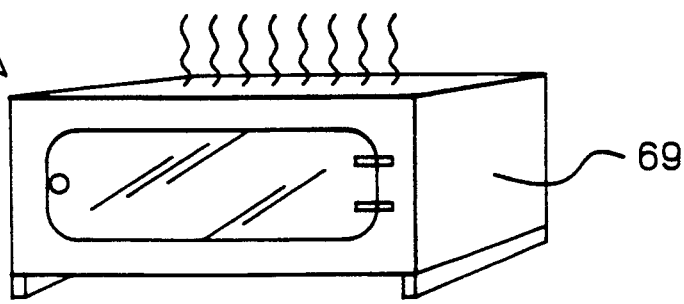

Referring to FIG. 5I, a second application of photoresist material is applied. The silicon wafer 64 is reinstalled on the spinner 65 and a liquid photolithographic resist 81 is placed on the segments 73 and the wafer 64. The wafer 64 is spun through a conventional cycle to spread the resist 81 in a uniform thickness overlying the segments 73. The wafer 64 is thereafter removed from the spinner, FIG. 5J, placed in a convection oven 69, and again soft baked, FIG. 5K, to drive off the volatile solvents. This step is not intended to polymerize the resist 81.

Figure 5L:
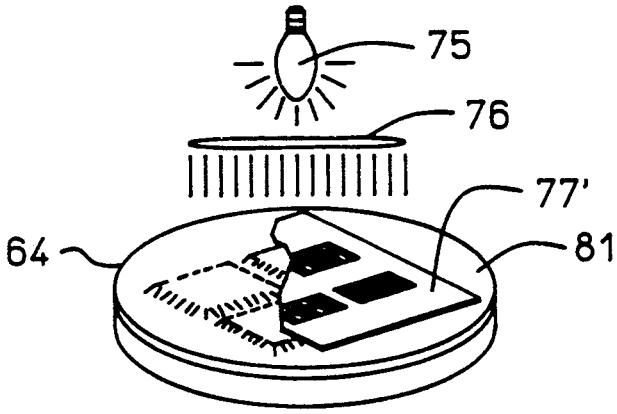

Referring to FIG. 5L, the wafer 64 is again subjected to a conventional integrated circuit, photolithographic imaging process. The photo mask 77', FIG. 5L is designed to produce the same pattern of barriers in the second layer 60, FIG. 6 as the first layer 58 and in registration in plan view. The same equipment and process is used in FIG. 5L as was described in connection with FIG. 5D. The amount of exposure energy necessary to polymerize the resist 81 however will be different because the resist material itself is different. At the end of the process, FIG. 5L, the second layer of resist 81 has been exposed to sufficient ultraviolet light so that the resist is polymerized in those areas where the light impinged. The areas where the light did not impinge are not polymerized and these unexposed areas are chemically and mechanically removed in an ultrasonic developing tank 79, FIG. 5M. The same process is followed as was described in connection with FIG. 5E except a developer is used that is appropriate for the photolithographic resist 81. Next, the silicon wafer 64 is rinsed with a spray of butylacetate, FIG. 5N, and then dried with a spray of nitrogen gas, FIG. 50.

Referring to FIG. 5P, the wafer 64 is thereafter subjected to a second blanket exposure that partially cross-links and cures the second layer 60 of the barrier. The same apparatus and process is used as was described in connection with FIG. 5H. However, the exposure energy may be different because of the differing resist material. When the process illustrated in FIG. 5P is complete, the result is a plurality of pen heads 14 as illustrated in FIG. 4 without the pen body 12 and adhesive 28.

The pen head 14, FIG. 2, is attached to the orifice plate 22 by first tacking it in place using both pressure and heat. Thereafter, the pen head and orifice plate are subjected to a longer bake and pressure cycle. This longer bake and pressure cycle ensures the chemical resistance of the barrier 24 to the ink as well as ensures the adhesive bonding between the orifice plate 22 and the first layer 58 by the second layer 60.

ALTERNATIVE EMBODIMENTS

The first layer of the barrier 24, FIG. 2 can be fabricated from a photoimageable epoxy resin such as epoxy/acrylate. These materials have a molecular weight of between 100 and 500 before cross-linking and provide good chemical resistance to high pH inks as well as the required definition. One such epoxy/acrylate barrier material is Dynachem X-3007.

Figure 7:
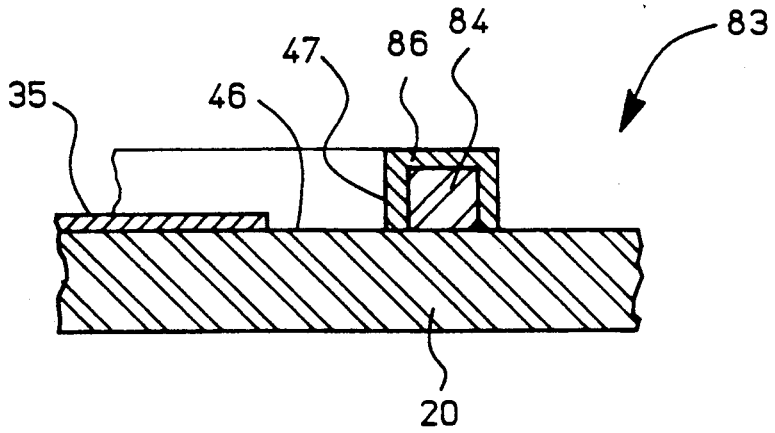
FIG. 7 is a side elevational view in cross section and cutaway of an alternative embodiment of the barrier structure of FIG. 6.

An alternative barrier 83 is illustrated in FIG. 7. This alternative barrier includes a first layer 84 which is cured onto the substrate 20 and a second layer 86 which completely covers the exposed surfaces of the first layer. The second layer in particular covers all of the side walls of the barrier so that the first layer is chemically isolated from the ink. The embodiment illustrated in FIG. 7 permits the use of positive photoresist materials such as those currently used in the semiconductor industry today. These positive photoresists are more stable, predictable and more easily fabricated than the negative photoresists described above. Needless to say, however, the second layer 86 can also be a negative photoresist. The embodiment illustrated in FIG. 7 is manufactured in accordance with the processes described above except the dimensions of the photo mask must be adjusted so that the resulting dimensions of the barrier are the same.

The foregoing description of the preferred embodiments of the present invention has been presented for the purposes of illustration and description. It is not intended to be exhaustive nor to limit the invention to the precise form disclosed. Obviously many modifications and variations are possible in light of the above teaching. The embodiments were chosen in order to best explain the best mode of the invention. Thus, it is intended that the scope of the invention be defined by the claims appended hereto.

What is claimed is:

1. A pen head for a drop-on-demand ink pen, comprising:

a. a substrate;

b. a member having an orifice therein;

c. a barrier segment formed on the substrate, said segment having an ink conduit and a chamber both formed therein and both in fluid communication, said chamber being connected to an ink reservoir via the ink conduit, said barrier segment having a first layer of a first photoimaged material on the substrate, the first layer having a plurality of substantially planar side walls that constitute the ink conduit and the chamber, and a second layer of a second photoimaged thermoplastic material overlying the first layer and permanently bonding the orifice member to the barrier segment and preventing the orifice member from delaminating after lengthy exposure to inks; and d. means within the printhead for expelling on demand drops of ink through the orifice from the chamber.

2. The pen head of claim 1 wherein the first layer of the barrier segment is formed from a soldermask material and the second layer is formed from an integrated circuit photolithographic resist material.

3. The pen head of claim 1 wherein one layer has a thickness in the range of 10 to 20 microns and the other layer has a thickness in the range of 1 to 10 microns.

4. The pen head of claim 2 wherein the first layer of the barrier segment has a thickness in the range of 10 to 20 microns and the second layer has a thickness in the range of 1 to 10 microns.

5. The pen head of claim 1 wherein the first layer of the barrier segment is fabricated from an epoxy/acrylate photoimageable material.

6. The pen head of claim 1 wherein the second layer of the barrier segment is fabricated from an integrated photolithographic resist material.

7. The pen head of claim 1 wherein the second layer of the barrier segment is formed on the first layer, said second layer having the same overlying pattern as the first layer and being in registration with the first layer.

8. The pen head of claim 1 wherein the second layer of the barrier segment is formed on the first layer, said second layer coating the side walls of first layer and thereby preventing chemical contact between the first layer and the ink.

9. The pen head of claim 8 wherein the first layer is formed from a positively acting photoimageable material.

10. The pen head of claim 1 wherein the first layer of the barrier segment is fabricated from a polymide material.

11. The pen head of claim 1 wherein the first layer of the barrier segment is fabricated from a photoimageable polyimide layer.

12. The pen head of claim 1 wherein the first layer of the barrier segment is fabricated from a dry film soldermask.

13. The pen head of claim 1, wherein the first layer of the barrier segment is fabricated from DuPont Vacrel.

14. The pen head of claim 1, wherein the second layer of the barrier segment is fabricated from Waycoat SC Resist 900.

15. The pen head of claim 1, wherein the first layer of the barrier segment is fabricated from a dry film.

16. The pen head of claim 1 wherein the ink conduit has a height between about 10 and 30 microns and a width between about 15 and 35 microns.

17. The pen head of claim 1 wherein the sidewalls are substantially parallel.

18. A method for manufacturing a drop-on-demand ink pen head, said pen head having means for expelling on demand drops of ink through an orifice member, comprising the steps of:

a. forming a first layer of a first photoimageable, thermoplastic material on a substrate;
b. forming a second layer of a second photoimageable material overlying the first layer, said first and second layer being a barrier segment;
c. forming in the barrier segment an ink conduit and a firing chamber; and
d. permanently bonding an orifice member to the first layer with the second layer so that it does not delaminate after lengthy exposure to inks.

19. The method of claim 18 wherein the step forming the first layer includes the step of polymerizing the first layer prior to forming the second layer.

20. The method of claim 18 wherein the step of forming the first layer includes the step of polymerizing the first layer and the step of forming the second layer includes the step of polymerizing the second layer, said first layer polymerizing step being completed before the second layer polymerizing step.

21. The method of claim 18 wherein the step of forming the second layer includes the step of imaging a photomask pattern of the first layer onto the second layer in registration.

22. The method of claim 18 wherein the step of forming the second layer includes coating the sidewall surfaces of the first layer with photoimaged material.

23. A pen head for a drop-on-demand in pen, comprising:

a. a substrate;
b. a member having an orifice therein;
c. a barrier segment formed on the substrate, said segment having an ink conduit and a chamber both formed therein and both in fluid communication, said chamber being connected to an ink reservoir via the ink conduit, said barrier segment having a first layer of a photoimaged epoxy acrylate material having a thickness in the range of 10 to 20 microns on the substrate, the first layer having a plurality of substantially planar side walls that constitute the ink conduit and the chamber, and a second layer of a photoimaged Waycoat SC 900 material, having a thickness in the range of 1 to 10 microns, overlying the first layer and permanently bonding the orifice member to the barrier segment and preventing the orifice member from delaminating after lengthy exposure to inks; and
d. means within the printhead for expelling on demand drops of ink through the orifice from the chamber.

* * * * *